US007522862B2

(12) United States Patent
Suganuma

(10) Patent No.: US 7,522,862 B2
(45) Date of Patent: Apr. 21, 2009

(54) NEUTRALIZATION DEVICE AND IMAGE FORMING UNIT FOR USE IN IMAGE FORMING APPARATUS, AND THE IMAGE FORMING APPARATUS

(75) Inventor: Toshihiro Suganuma, Tokyo (JP)

(73) Assignee: Fuji Xerox Co., Ltd., Tokyo (JP)

( * ) Notice: Subject to any disclaimer, the term of this patent is extended or adjusted under 35 U.S.C. 154(b) by 113 days.

(21) Appl. No.: 11/603,053

(22) Filed: Nov. 22, 2006

(65) Prior Publication Data

US 2007/0258728 A1 Nov. 8, 2007

(30) Foreign Application Priority Data

May 2, 2006 (JP) ..... 2006-128426

(51) Int. Cl.
*G03G 21/00* (2006.01)

(52) U.S. Cl. ..... 399/128

(58) Field of Classification Search ..... 399/98, 399/107, 111, 118, 126, 127, 128
See application file for complete search history.

(56) References Cited

U.S. PATENT DOCUMENTS 4,785,324 A * 11/1988 Yamazaki et al. ..... 399/128
6,738,588 B2 * 5/2004 Yokomori et al. ..... 399/111
2005/0220480 A1 * 10/2005 Miyabe et al. ..... 399/111

FOREIGN PATENT DOCUMENTS

JP 01-291279 A 11/1989
JP 2001-154552 A 6/2001
JP 2003-295717 A 10/2003

OTHER PUBLICATIONS

Chinese Office Action dated Oct. 10, 2008.

* cited by examiner

*Primary Examiner*—Sandra L Brase
(74) *Attorney, Agent, or Firm*—Sughrue Mion, PLLC

(57) ABSTRACT

A neutralization device is disposed in an image forming apparatus having an image carrier so as to face the image carrier. The device comprises: a light irradiation section that irradiates neutralization light onto the image carrier; a case member that accommodates the light irradiation section and is opened to a side facing the image carrier; and a buffer member that is provided between the case member and the image carrier and prevents the light irradiation section from abutting against the image carrier.

24 Claims, 6 Drawing Sheets

NEUTRALIZATION DEVICE AND IMAGE FORMING UNIT FOR USE IN IMAGE FORMING APPARATUS, AND THE IMAGE FORMING APPARATUS

BACKGROUND (i) Technical Field

The present invention relates to a neutralization device and an image forming unit for use in an image forming apparatus, and to an image forming apparatus.

(ii) Related Art

Image forming apparatuses, such as a copier and a printer, utilizing electrophotography are configured so that an electrostatic latent image formed on, for example, a photoreceptor drum is developed by a development unit using developer (toner) to perform visualization (that is, form a toner image), and that this toner image is transferred and fixed onto a recording medium, such as recording paper.

Such an image forming apparatus has a cleaning unit adapted to remove toner remaining on the surface of the photoreceptor drum after the toner image is transferred onto the recording medium, such as recording paper or an intermediate transfer body.

Additionally, some image forming apparatus has a neutralization device adapted to remove residual potential of the photoreceptor after the transfer. Thus, the remaining potential of the photoreceptor is removed by the neutralization device. Consequently, a ghost image can be prevented from being formed due to the charging hysteresis of the photoreceptor.

An image forming apparatus has been known, which is configured so that an image forming unit (what is called a process cartridge) is constructed by integrating a photoreceptor drum and operating portions, such as a development device, which are disposed therearound and relate to an electrophotographic process, and that the image forming unit is adapted to be detachable from an image forming apparatus body. This configuration can facilitate the supply of toner to the development device and the replacement of the photoreceptor drum.

SUMMARY

There is provided a neutralization device disposed in an image forming apparatus having an image carrier so as to face the image carrier, the device comprising: a light irradiation section that irradiates neutralization light onto the image carrier; a case member that accommodates the light irradiation section and is opened to a side facing the image carrier; and a buffer member that is provided between the case member and the image carrier and prevents the light irradiation section from abutting against the image carrier.

DETAILED DESCRIPTION

Hereinafter, an embodiment of the invention is described in detail with reference to the accompanying drawings.

Figure 1:
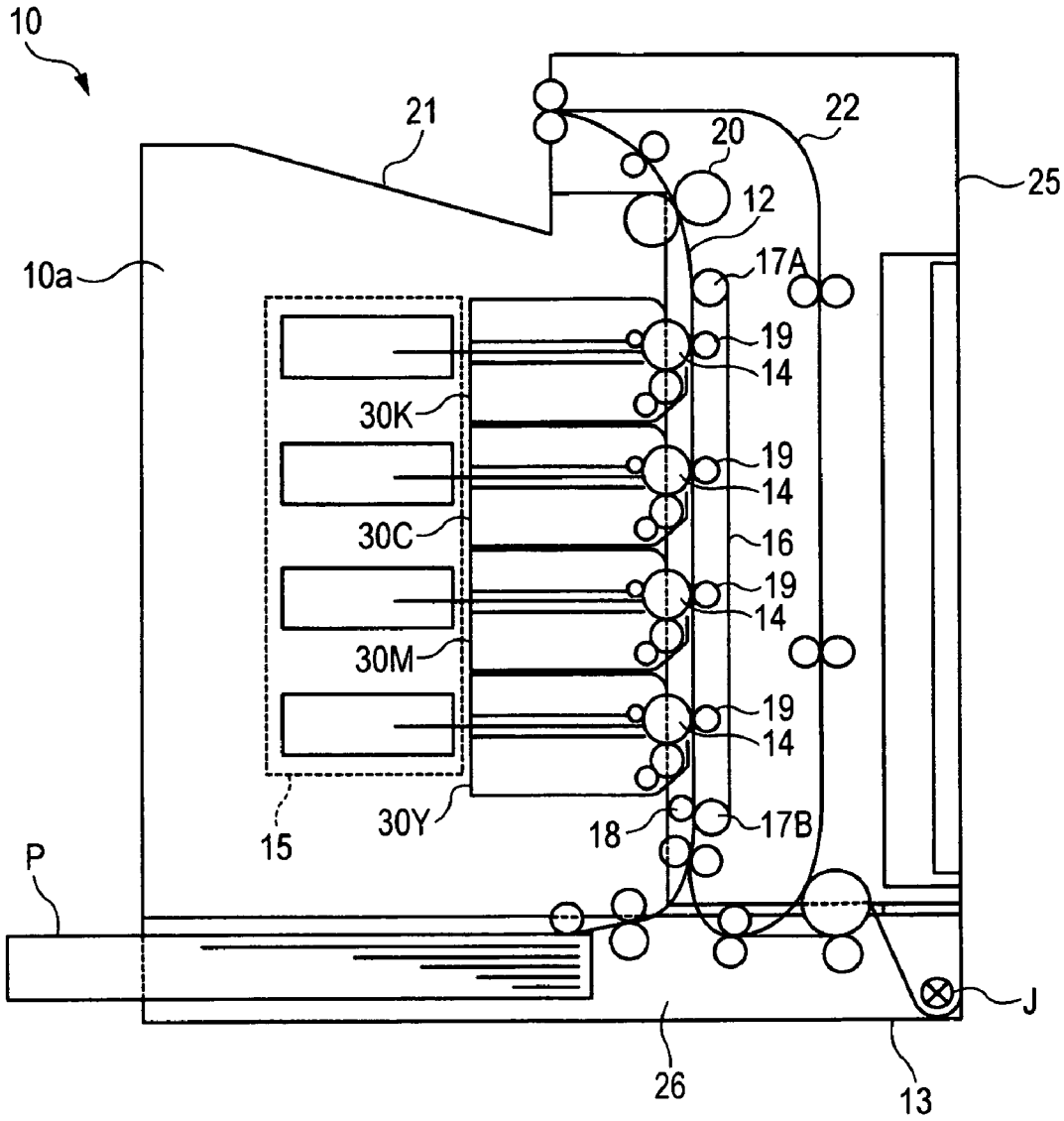
FIG. 1 is a schematic view showing the configuration of an image forming apparatus according to the invention.
Figure 2:
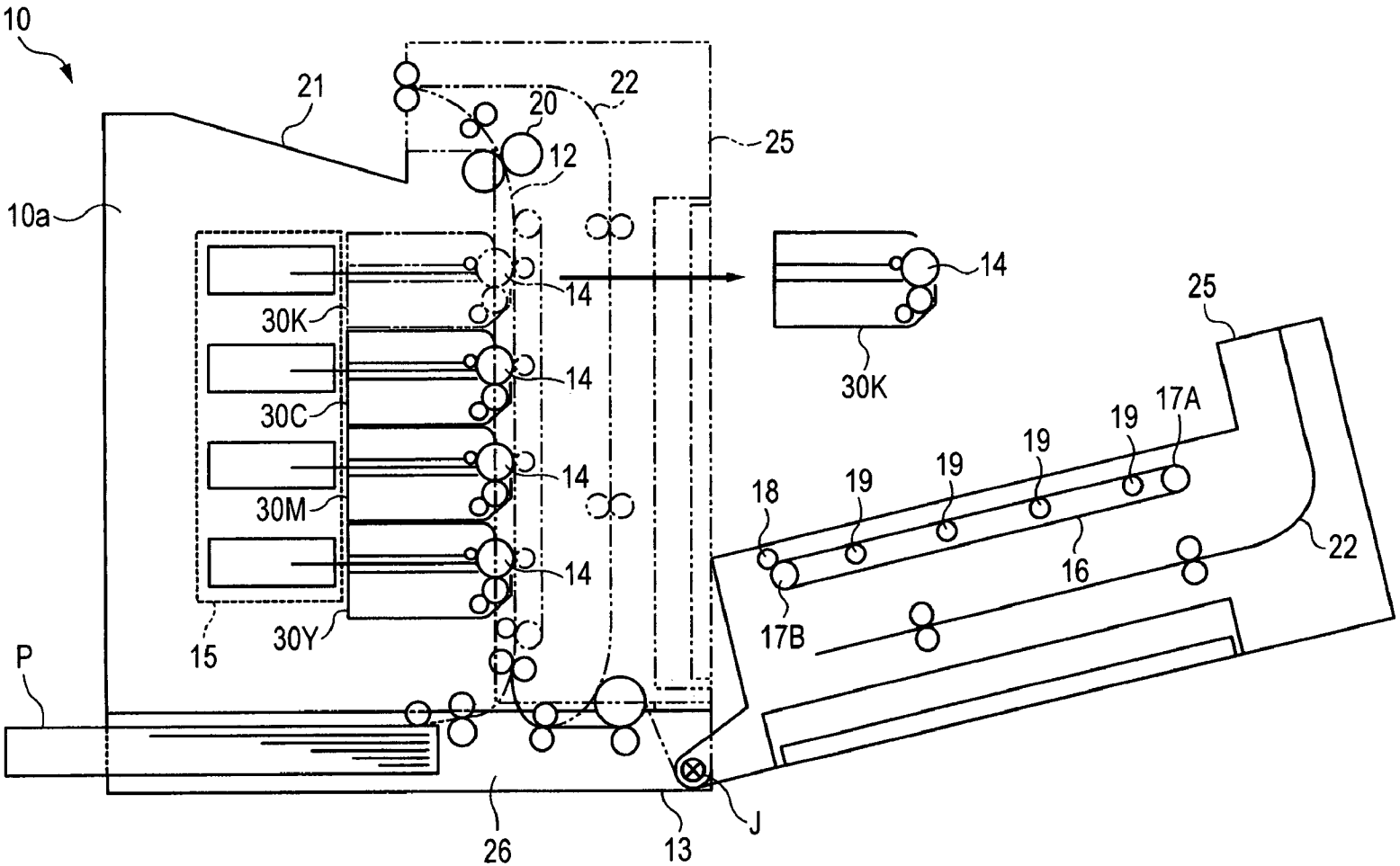
FIG. 2 is a schematic view showing a state in which a front cover for the image forming apparatus is opened.

FIG. 1 is a schematic view showing the configuration of an image forming apparatus according to the present embodiment. FIG. 2 is a schematic view showing a state in which a front cover for this image forming apparatus is opened.

An image forming apparatus shown in FIG. 1 is of what is called a tandem type, in which four color process cartridges 30 (30Y, 30M, 30C, and 30K) are longitudinally and sequentially arranged in a body 10*a*. Also, a conveying path 12 adapted to convey recording paper P substantially vertically from below to above is disposed at an associated place of each of the process cartridges 30. A paper feed cassette 13 adapted to accommodate recording paper P, which is conveyed on the conveying path 12 so that toner images are sequentially transferred thereonto, is disposed below (or upstream) the lowest (or most upstream) process cartridge 30Y.

The process cartridges 30 (30Y, 30M, 30C, and 30K) are disposed so that the process cartridge 30Y adapted to form yellow (Y) toner images, the process cartridge 30M adapted to form magenta (M) toner images, the process cartridge 30C adapted to form cyan (C) toner images, the process cartridge 30K adapted to form black (K) toner images are serially arranged from the upstream side (the bottom side, as viewed in FIG. 1) of the conveying path 12 in this order. The process cartridges 30 have a similar configuration except for the color of toner. Thus, hereunder, the process cartridges 30Y, 30M, 30C, and 30K are generically described as the process cartridge 30 except in a case where it is necessary to individually describe the process cartridges 30Y, 30M, 30C, and 30K. The process cartridge 30 is a cartridge into which a photoreceptor drum (image carrier) 14 and various electrophotographic devices serially disposed around the photoreceptor drum 14 are integrated. When the toner contained in the process cartridge 30 is consumed, the entirety of the process cartridge 30 is replaced with a new one. This process cartridge 30 is an image forming unit according to the present embodiment. The configuration of the process cartridge 30 will be described later in detail.

An exposure device 15, which is common to the process cartridges 30, is disposed opposite to the conveying path 12 across each of the process cartridges 30. The exposure device 15 turns on and drives an associated one of semiconductor lasers (not shown) respectively corresponding to the four colors according to image data corresponding to an associated one of the four colors. Then, light beams outputted from each of the four semiconductor lasers are deflected and scanned by an associated one of polygon mirrors (not shown). Subsequently, the laser beams are guided to an exposure point on each of the photoreceptor drums 14 through an fθ-lens and a plurality of reflection mirrors. Thus, a light image is formed on each of the photoreceptor drums 14.

A conveying belt 16 performing circulation movement along the conveying path 12 is disposed to pass through places respectively corresponding to the photoreceptor drums 14 of the process cartridges 30. The conveying belt 16 is formed of a belt material that can electrostatically adsorb the recording paper P. The conveying belt 16 is laid across a pair of a drive roller 17A and a driven roller 17B. Also, an adsorption roller 18 adapted to cause the conveying belt 16 to electrostatically adsorb the recording paper P is disposed on the conveying path 12.

A transfer roller 19 is disposed at each of places on the rear surface side of the conveying belt 16, which respectively correspond to the photoreceptor drums 14 of the process cartridges 30. Each of the transfer rollers 19 brings an associated one of the photoreceptor drums 14 to be in close contact with the recording paper P on the conveying belt 16 to thereby transfer a toner image, which is formed on the associated photoreceptor drum 14, onto the recording paper P.

A fixing device 20 is provided on the conveying path 12 above (or downstream from) the highest (most downstream) process cartridge 30K. A paper ejection portion 21 adapted to accommodate the ejected recording paper P, to which a toner image is fixed by the fixing device 20, is provided integrally with the body 10*a*. Also, a reverse conveying path 22 adapted to reverse the front surface and the back surface of the recording paper P, on one of the surfaces of which the image is fixed by the fixing device 20, and to feed the reversed paper to the conveying path 12 is placed in the body 10*a*.

As shown in FIG. 2, a front cover 25 is provided on the body 10*a* of the image forming apparatus 10 to be able to turn around a turning supporting point provided at the bottom thereof. The front cover 25 functions as an external cover together with the body 10*a* when closed. That is, the front cover 25 constitutes a side wall portion placed above the paper feed cassette 13 at the front side of the image forming apparatus 10.

The conveying belt 16, the drive roller 17A, the driven roller 17B, the adsorption roller 18, the transfer roller 19 and the reverse conveying path 22 are attached to the front cover 25. Therefore, when the front cover 25 is opened, these components follow the front cover 25 and are moved away from the body 10*a*. Thus, the process cartridge 30 is exposed by opening the front cover 25. This facilitates a user's access to the conveying path 12.

Incidentally, each of the process cartridges 30 is detachably attached in a substantially horizontal direction to the body 10*a*, similarly to the process cartridge 30K shown in FIG. 2 as an example. Thus, each of the process cartridges 30 can be attached thereto or detached therefrom by opening the front cover 25 for the body 10*a*. Incidentally, a set-condition detecting sensor (not shown) detects the set condition of each of the process cartridges 30 and outputs results of the detection to a control device (not shown).

Thus, the process cartridges 30 can be exposed and replaced by opening the front cover 25. Also, a paper jam can be handled (that is, jam clearance can be achieved) by exposing the photoreceptor drum 14.

The image forming apparatus 10 of the above configuration forms an image by performing the following operation.

First, when image data is inputted to the image forming apparatus 10 from an image reading apparatus (a scanner (not shown)) or a computer system (not shown), the image data respectively corresponding to the colors (Y, M, C, K) are outputted the exposure devices 15 after an image processing apparatus (not shown) performs predetermined image processing thereon.

The exposure devices 15 irradiate exposure beams, which are outputted from the semiconductor lasers according to input image data respectively corresponding to the colors, onto the photoreceptor drums 14 of the process cartridges 30. In each of the process cartridges 30, an electrostatic latent image formed on the photoreceptor drums 14 by exposure is developed by toner of the associated color to thereby form a toner image.

Subsequently, toner images respectively formed on the photoreceptor drums 14 of the process cartridges 30 are serially superimposed and transferred onto the recording paper P, which is supplied from a cassette paper feed portion 26 by being adsorbed to the conveying belt 16 by the action of the adsorption roller 18, by a transfer portion abutting against the transfer rollers 19.

Then, the recording paper P, onto which the toner images are electrostatically transferred, is conveyed to the fixing device 20. Subsequently, the fixing device 20 fixes the toner images thereonto by heat and pressure. Thereafter, the recording paper P is ejected to the paper ejection portion 21 provided in the upper portion of the image forming apparatus 10. Thus, a sequence of an image forming process is finished.

Next, the process cartridge 30 embodying an image forming unit according to the invention is described in detail below.

Figure 3:
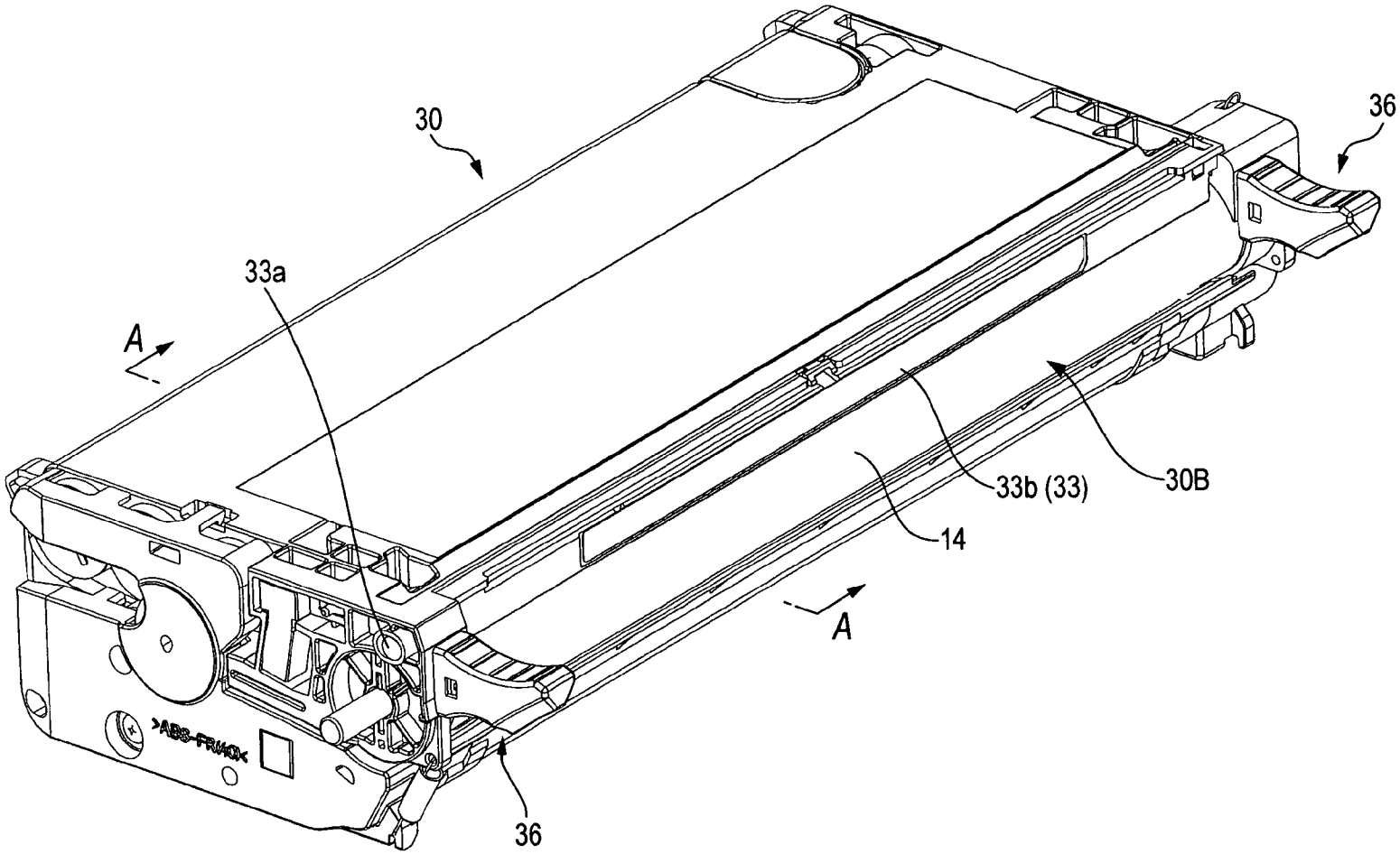
FIG. 3 is a perspective view showing an external appearance of a process cartridge.
Figure 4:
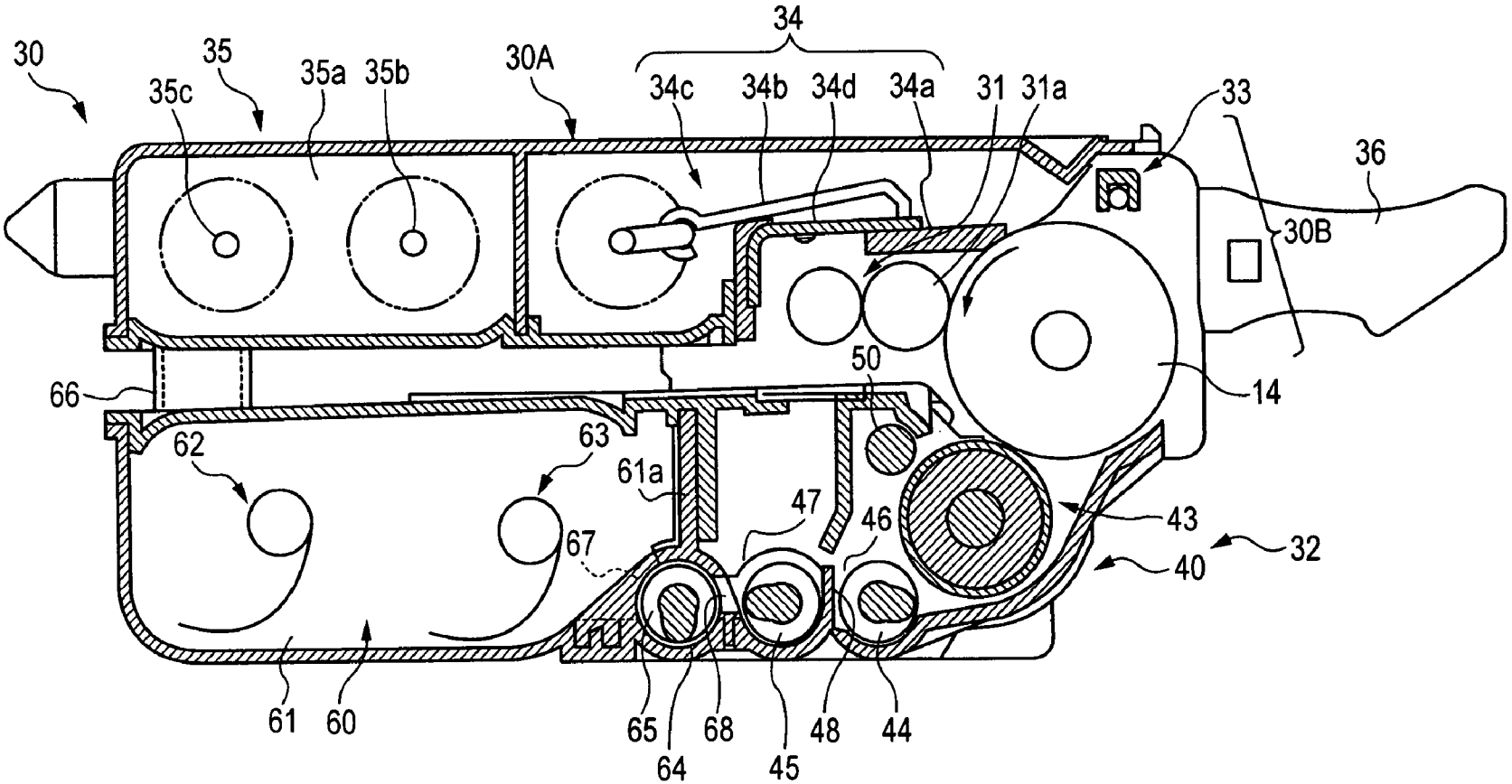
FIG. 4 is a cross-sectional view taken on line A-A shown in FIG. 3.

FIG. 3 is a perspective view showing an external appearance of the process cartridge 30. FIG. 4 is a cross-sectional view taken on line A-A shown in FIG. 3.

Each of the process cartridges 30 has the photoreceptor drum 14, an electrification device 31, a developing device 32, a neutralization device 33, a cleaning device 34, and an auxiliary toner replenishing portion 35, which are provided in a housing 30A.

The outer shape of each of the process cartridges 30 is a flat hexahedron as shown in FIG. 3. Each of the process cartridges 30 is roughly partitioned into two upper and lower layers. An optical path space, through which exposure beams outputted from the exposure devices 15 pass, is provided between the upper and lower layers.

The electrification device 31, the cleaning device 34, and the auxiliary toner replenishing portion 35 are configured in the upper layer, while the developing device 32 is configured in the lower layer. The photoreceptor drum 14 is placed at the right end of the space between the upper and the lower layers, as viewed in FIG. 4.

Hereinafter, description is made by assuming that the direction of the axis of each of the photoreceptor drums 14 is a lateral direction, that a horizontal direction perpendicular to the direction of the axis thereof is an anteroposterior direction (a side, at which each of the photoreceptor drums 14 is disposed, is a frontward direction), and that a direction perpendicular to the anteroposterior direction and to the lateral direction is an up-down direction.

Each of the photoreceptor drums 14 has a part whose predetermined range extending in an up-down direction is exposed through an opening portion 30B formed in a front-side portion of the housing 30A. Each of the photoreceptor drums 14 is in contact with the recording paper at this part and transfers the toner image thereonto.

Additionally, knobs 36 serving as held portions are provided at both lateral ends of each of the front sides of the process cartridges 30, respectively. The knobs 36 are placed at the left side and the right side of the opening portion 30B through which each of the photoreceptor drums 14 is exposed from the housing 30A. When the process cartridge 30 is mounted or replaced, an operator holds the knob 36. Each of the knobs 36 has the function of fixing the process cartridge 30 to a predetermined place by a swinging operation. That is, operations of mounting and replacing the process cartridge 30 are performed by holding the knob 36.

Next, each of operating portions of the process cartridge 30 is described below.

The photoreceptor drum 14 is rotatably disposed therein and is rotationally driven by a drive motor (not shown) in the direction of an arrow shown in FIG. 4. A photosensitive layer is formed on an outer circumference surface of each of the photoreceptor drums 14. The electrification device 31, the developing device 32, the neutralization device 33 serving as the light irradiation neutralization device, and the cleaning device 34 are disposed around the photoreceptor drum 14 along the direction of rotation, which is designated by the arrow in FIG. 4.

Additionally, as the photoreceptor drum 14 rotates, the photoreceptor provided on the circumference surface is electrified by the electrification device 31. The developing device 32 develops an electrostatic latent image, which is formed by the exposure device 15, into a toner image. Also, the neutralization device 33 eliminates the charging hysteresis of the photoreceptor after the toner image is transferred onto the recording paper. The cleaning device 34 mechanically removes toner remaining on the photoreceptor.

The electrification device 31 is constructed by disposing a charging roll 31*a*, to which a charging bias is applied, to be in contact with the photoreceptor drum 14. Thus, the photoreceptor drum 14 is charged to a predetermined electric potential (of a negative polarity in the present embodiment).

The developing device 32 is constructed by integrating a developing portion 40, which is adapted to develop an electrostatic latent image on the photoreceptor drum 14 by using toner, with a main toner replenishing portion 60 in a horizontal direction. Additionally, the auxiliary toner replenishing portion 35 constitutes a part of the developing device 32 and is adapted to replenish the main toner replenishing portion 60 with toner. Incidentally, the developing device 32 is of the two-component type that uses developer including toner and carrier.

The developing portion 40 has a developing roll 43, a pair of augers including a supply auger 44 and a stirring auger 45, and a layer thickness regulating member 50.

The supply auger 44 is disposed in a supply region adjoining the developing roll 43. The stirring auger 45 is disposed in a stirring region 47, which is separated from the supply region by a partitioning wall 48. Incidentally, the partitioning wall 48 is not provided in a predetermined range from each of both the left and right end portions. In this portion, developer can circulate between the supply region 46 and the stirring region 47.

The main toner replenishing portion 60 has a toner accommodating chamber 61, which is separated from a partitioning wall 61*a*, and a toner replenishing chamber 64.

Agitators 62 and 63 are provided in the toner accommodating chamber 61. Also, a replenishment auger 65 is provided in the toner replenishing chamber 64.

The toner accommodating chamber 61 and the toner replenishing chamber 64 communicate with each other through a toner carry-in port 67. Further, the toner replenishing chamber 64 and the stirring region 47 communicate with each other through a toner replenishing port 68. Consequently, the toner accommodated in the toner accommodating chamber 61 can be supplied to the developing portion 40 through the toner carry-in port 67, the toner replenishing chamber 64, and the toner replenishing port 68.

The auxiliary toner replenishing portion 35 has auxiliary agitators 35*b* and 35*c* provided in an auxiliary toner accommodating chamber 35*a*. The auxiliary toner replenishing portion 35 is connected to the main toner replenishing portion 60 through a connecting passage 66.

Further, the developing device 32 of the above configuration performs the following operation when an image is formed.

In the developing portion 40, the developer is circulated and conveyed by the supply auger 44 and the stirring auger 45 while stirred. The developer is electrified by the friction between the toner and the carrier. Then, the developer is supplied to the developing roll 43. Consequently, the toner is transferred to the electrostatic latent image on the photoreceptor drum 14 through the developing roll 43 to thereby visualize the latent image (into a toner image).

The toner is consumed as a development operation is performed. Thus, when the concentration of toner in the developer is reduced, the main toner replenishing portion 60 supplies to the toner replenishing chamber 64 the toner accommodated in the toner accommodating chamber 61 through the toner carry-in port 67. The toner held in the toner replenishing chamber 64 is conveyed by the replenishing auger 65. Thus, the toner is supplied to the stirring region 47 of the developing portion 40 through the toner replenishing port 68. The toner is replenished to the toner accommodating chamber 61 from the auxiliary toner replenishing portion 35 through the connecting passage 66.

The neutralization device 33 is placed on the upper edge part of the opening portion 30B formed in the housing 30A to face the photoreceptor drum 14. Then, after the transfer process is finished, the photoreceptor of the photoreceptor drum 14 is irradiated with neutralization light at the upstream side of the cleaning device 34. The characteristic configuration according to the invention is applied to the neutralization device 33. The neutralization device 33 is described in detail later.

The cleaning device 34 has a cleaning blade 34*a* and a toner collection mechanism 34*b*.

The cleaning blade 34*a* is formed of a urethane rubber and is shaped like a plate. The cleaning blade 34*a* is supported like a bracket 34*d*, and is disposed by being press-contacted in a direction opposite to the direction of rotation of the photoreceptor drum 14. Then, the toner remaining on the surface of the photoreceptor drum 14 upon completion of the transfer is removed by being scraped by the cleaning blade 34*a*. The toner scraped by the cleaning blade 34*a* is transported to a collection portion 34*c* by the toner collection mechanism 34*b*.

Next, the neutralization device 33 having a configuration characteristic to the present embodiment is described in detail below.

Figure 5:
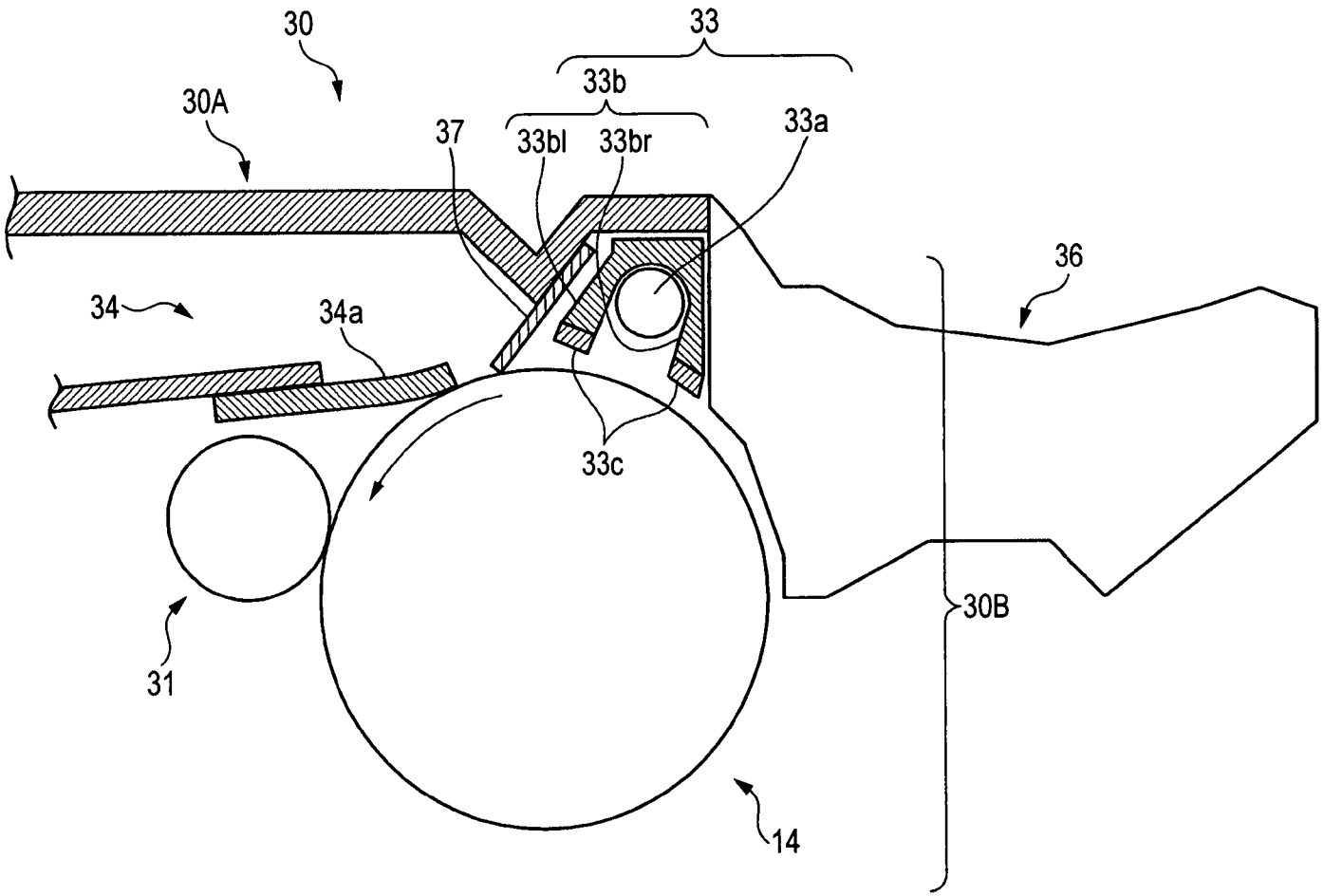
FIG. 5 is an enlarged cross-sectional view showing a neutralization device including a photoreceptor drum.

FIG. 5 is an enlarged cross-sectional view showing a neutralization device including a photoreceptor drum.

The neutralization device 33 has a light guide 33*a* serving as a light irradiating section that guides neutralization light, and also has an accommodating case 33*b* serving as a case member adapted to accommodate the light guide 33*a*. The outer shape of the neutralization device 33 is like a bar extending over the entire length in the longitudinal direction of the photoreceptor drum 14. The neutralization device 33 is attached to the bottom surface of an upper edge part of the opening portion 30B of the housing 30A. Incidentally, reference numeral 37 designates a seal member adapted to divide off the neutralization device 33 from the cleaning device 34 located downstream therefrom in the downstream side in the direction of rotation of the photoreceptor drum 14. The seal member 37 is fixed to the housing 30A on the upper base edge portion. The seal member 37 is provided so that the free edge part of the other end portion thereof is in contact with the photoreceptor drum 14. Thus, the seal member 37 prevents dust, such as toner cloud, from flowing into the neutralization device 33 from the cleaning device 34.

The light guide 33*a* is shaped like a cylinder, which has a predetermined diameter and also has a length corresponding to that of the photoreceptor drum 14, and is formed of glass or a resin (such as an acrylic resin or a polycarbonate resin) which excels in translucency. Although the details of the light guide 33*a* are not shown, the light guide 33*a* is configured so that light having been incident from an end surface thereof is reflected to a circumferential surface thereof. For example, unevenness is formed in a part of the light guide 33*a*, which is opposite to a side facing the photoreceptor drum 14. Due to this unevenness, substantially uniform light is axially irradiated over the photoreceptor drum 14.

The accommodating case 33*b* is cross-sectionally substantially-U-shaped, which has an irradiation opening portion whose width corresponds to the diameter of the light guide 33*a*. The accommodating case 33*b* is formed of, for example, a white resin by injection-molding so that at least an inner surface has high light reflection efficiency. Also, buffer members 33*c* are respectively provided on the end surfaces of both the side plates 33*br* and 33*bl* of the irradiation opening portion, which face the photoreceptor drum 14.

The buffer members 33*c* are formed of a material, for example, urethane foam sponge that does not damage the photoreceptor of the photoreceptor drum 14 even when the buffer member 33*c* is brought into contact with the photoreceptor. Preferably, the color of each of the buffer members 33*c* is black, which has light shielding property so as to prevent light from leaking to the outside.

Further, the neutralization device 33 is configured so that the accommodating case 33*b* accommodates the light guide 33*a* in the irradiation opening portion thereof to cover the light guide 33*a*, and that the accommodating case 33*b* is attached to the bottom surface of the upper edge part of the opening portion 30B of the housing 30A to make the irradiation opening side thereof face the photoreceptor drum 14.

The light guide 33*a* is adapted so that an end surface thereof is exposed to the side of the side surface of the associated process cartridge 30, as shown in FIG. 2.

Incidentally, in the body 10*a* (see FIGS. 1 and 2) of the image forming apparatus 10, an LED lamp is provided at a place facing an end surface of the light guide 33*a* in a state in which the process cartridges 30 are attached to predetermined positions.

Consequently, light outputted from the LED lamp is incident upon the end surface of the light guide 33*a* of the associated process cartridge 30, which is mounted in the body 10*a* of the image forming apparatus 10. Additionally, the incident light is reflected as neutralization light by the light guide 33*a* to the photoreceptor provided on the circumferential surface of each of the photoreceptor drums 14. Thus, electricity is removed by irradiating the neutralization light.

That is, the LED lamp serving as a light source is provided in the body 10*a* of the image forming apparatus 10. A device (that is, the neutralization device 33) adapted to guide light from the LED lamp to each of the photoreceptor drums 14 is provided in the associated process cartridge 30.

Meanwhile, preferably, the light guide 33*a* is placed as close as possible to the photoreceptor provided on the circumferential surface of each of the photoreceptor drums 14 to enhance neutralization efficiency (that is, to obtain a high-degree neutralization effect by a small amount of light). Incidentally, the light guide 33*a* and the accommodating case 33*b* are spaced by an appropriate distance (ranging from about 2 mm to about 3 mm) so as not to touch and damage the photoreceptors.

However, because the neutralization device 33 is provided on the upper edge part of the opening portion 30B of the housing 30A, as described above, there is a fear that when the housing 30A is pressed, the housing 30A may bend, and that thus the light guide 33*a* and the accommodating case 33*b* may touch the photoreceptor. In the present embodiment, the knobs 36 (see FIGS. 3 and 4) are provided at both the left and right end portions of each of the process cartridges 30, as described above. Each of the process cartridges 30 is supported by holding the knob 36. However, the front side part of the just middle portion between the left and right knobs 36 may accidentally be held.

According to the present embodiment, even in such a Case, the buffer member 33*c* attached to the accommodating case 33*b* abut against the photoreceptor drum 14 so as to prevent the accommodating case 33*b* and/or the light guide 33*a* from directly abutting against the photoreceptor drum 14.

In addition, preferably, ,a gap of about 1 mm, for example, is provided between the surface of the buffer member 33*c* and the surface of the photoreceptor drum 14 to prevent adhering of remaining toner before cleaning.

Further, a region in which the buffer member 33*c* is disposed is not necessary extends over the entirety in the axial direction of the photoreceptor drum 14, and may be provided only in a central potion thereof where an amount of elastic deformation is large and the accommodating case 33*b* and/or the light guide 33*a* to have a predetermined length. Also, the buffer member 33*c* may be provided only on one of the side plates 33*br* and 33*b* 1, instead of being provided on both the side plates 33*br* and 33*b* 1.

Next, another example of the configuration of the buffer member is described below.

Figure 6:
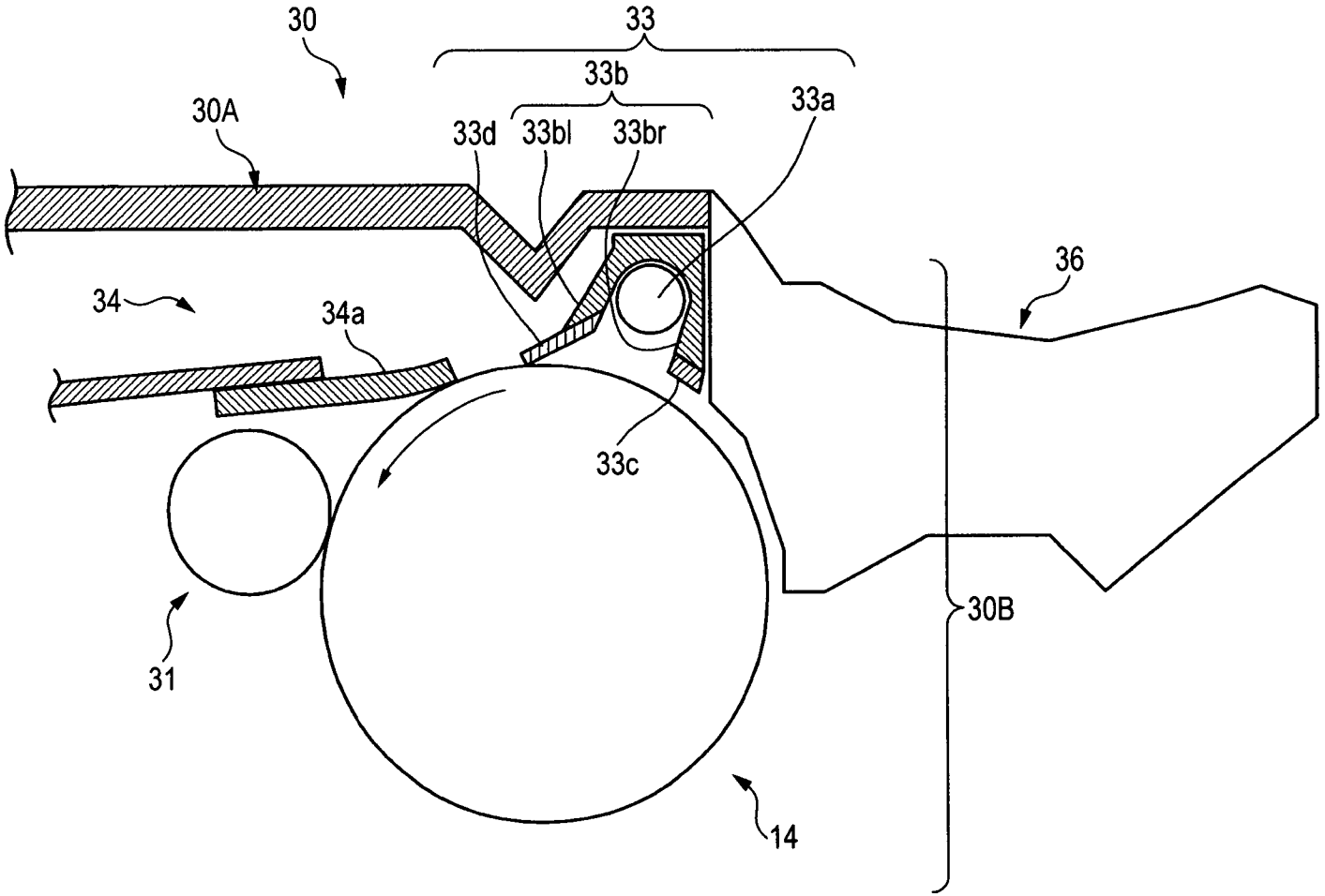
FIG. 6 is an enlarged cross-sectional view showing the periphery of the neutralization device provided with a buffer sheet, including the photoreceptor drum.

FIG. 6 is an enlarged cross-sectional view showing the periphery of the neutralization device 33 provided with the buffer sheet 33*d* serving as the buffer member, including the photoreceptor drum 14 corresponding to that shown in FIG. 5.

The buffer sheet 33*d* shown in FIG. 6 is formed of a flexible sheet that has predetermined elasticity and that is made of a material, such as a PET resin. The buffer sheet 33*d* is attached to the side plate 33*bl*, which is disposed at the side of the cleaning device 34 in the accommodating case 33*b*, at an upper base end edge part. The buffer sheet 33*d* is provided so that the free edge part of the other end thereof is put into contact with the photoreceptor drum 14.

Additionally, the buffer sheet 33*d* prevents the light guide 33*a* and the accommodating case 33*b* due to the stiffness (or what is called the elasticity) of the buffer sheet 33*d* from touching the photoreceptor. Also, the buffer sheet 33*d* prevents toner cloud from flowing into the neutralization device 33 from the cleaning device 34. Thus, the buffer sheet 33*d* can prevent an amount of light from being reduced due to the adhesion of the toner cloud to the light guide 33*a*. That is, the buffer sheet 33*d* of this configuration has both of a buffering function and a dust proofing function of preventing the toner cloud from flowing into the neutralization device 33 from the cleaning device 34. Additionally, preferably, the color of the buffer sheet 33*d* is, for example, black, which has light shielding property so as to prevent light from leaking to the outside.

In this example of the configuration of the buffer member, a buffer member 33*c*, which is similar to that of the above example of the configuration of the buffer member, is provided on the end surface of the other side plate 33*br* of the accommodating case 33*b*. This buffer member 33*c* may be omitted. However, the provision of this buffer member 33*c* can enhance a buffering effect still more.

Incidentally, the invention is not limited to the above embodiments. The invention can be applied to operating components other than the neutralization device 33. Also, the invention can be applied to devices other than the process card serving as the image forming unit. Additionally, the configuration of the image forming apparatus, to which the invention is applied, is not limited to the above embodiment.

What is claimed is:

1. A neutralization device disposed in an image forming apparatus having an image carrier so as to face the image carrier, the device comprising:

a light irradiation section that irradiates neutralization light onto the image carrier;

a case member that accommodates the light irradiation section and is opened to a side facing the image carrier; and a buffer member that is provided between the case member and the image carrier and prevents the light irradiation section from abutting against the image carrier;

wherein the light irradiation section, the case member and the buffer member are provided to be spaced from the image carrier.

2. The neutralization device according to claim 1, wherein the image forming apparatus flirt her has a seal member disposed on a downstream side of the light irradiation section in a rotation direction of the image carrier, one end of the seal member is attached to a housing that houses the image carrier, the other end of the seal member is in contact with the image carrier, and a position where the buffer member is provided is lower than a position where the one end of the seal member is attached to the housing.

3. The neutralization device according to claim 1, wherein a housing houses the image carrier, an opening portion is formed at the housing from which the image carrier is exposed, the case member is disposed at the opening portion, and the housing is bent when the housing is pressed.

4. The neutralization device according to claim 1, wherein, the buffer member is disposed only in a central portion of the case member in a axial direction of the image carrier.

5. An image forming unit detachably attached to an image forming apparatus body, the unit comprising:

an image carrier that is movement-driven and holds an electrostatic latent image;

a held portion that is held when attached to the image forming apparatus body;

an operating component disposed at a position close to the held portion around the image carrier; and a buffer member that is provided between the operating component and the image carrier and prevents the operating component from abutting against the image carrier;

wherein the operating component and the buffer member are provided to be spaced from the image carrier.

6. The image forming unit according to claim 5, wherein the operating component includes a neutralization device that removes electricity from the image carrier, and wherein the image forming unit further comprises a cleaning device that is placed downstream in a direction, in which the image carrier moves, from the neutralization device and cleans a surface of said image carrier.

7. The image forming unit according to claim 6, wherein the buffer member is disposed between the neutralization device and the cleaning device to prevent dust from flowing into the neutralization device from the cleaning device.

8. The image forming unit according to claim 7, wherein the buffer member comprises a light shielding material.

9. The image forming unit according to claim 5, wherein the operating component includes a light irradiation neutralization device that removes electricity by irradiating neutralization light onto the image carrier.

10. The image forming unit according to claim 5, further comprising:

a housing; and a seal member disposed on a downstream side of the light irradiation section in a rotation direction of the image carrier, wherein one end of the seal member is attached to the housing, the other end of the seal member is in contact with the image carrier, and a position where the buffer member is provided is lower than a position where the one end of the seal member is attached to the housing.

11. The image forming unit according to claim 5, further comprising:

a housing that houses the image carrier; and an opening portion formed at the housing from which the image carrier is exposed, wherein the operating component is disposed at the opening portion, wherein the housing is bent when the housing is pressed.

12. The image forming unit according to claim 5, wherein the buffer member is disposed only in a central portion of the operating component in a axial direction of the image carrier.

13. An image forming unit detachably attached to an image forming apparatus body, the unit comprising:

an image carrier that is movement-driven and holds an electrostatic latent image;

an opening portion from which the image carrier is exposed;

an operating component disposed at a position close to the opening portion around the image carrier; and a buffer member that is provided between the operating component and the image carrier and prevents the operating component from abutting against the image carrier;

wherein the operating component and the buffer member are provided to be spaced from the image carrier.

14. The image forming unit according to claim 13, wherein the operating component includes a neutralization device that removes electricity from the image carrier, and wherein the image forming unit further comprises a cleaning device that is placed downstream in a direction, in which the image carrier moves, from the neutralization device and cleans a surface of said image carrier.

15. The image forming unit according to claim 14, wherein the buffer member is disposed between the neutralization device and the cleaning device to prevent dust from flowing into the neutralization device from the cleaning device.

16. The image forming unit according to claim 15, wherein the buffer member comprises a light shielding material.

17. The image forming unit according to claim 13, wherein the operating component includes a light irradiation neutralization device that removes electricity by irradiating neutralization light onto the image carrier.

18. The image forming unit according to claim 13, further comprising:

a housing; and a seal member disposed on a downstream side of the light irradiation section in a rotation direction of the image carrier, wherein one end of the seal member is attached to the housing, the other end of the seal member is in contact with the image carrier, and a position where the buffer member is provided is lower than a position where the one end of the seal member is attached to the housing.

19. The image forming unit according to claim 13, further comprising:

a housing at which the opening potion formed, wherein the operating component is disposed at the opening portion, wherein the housing is bent when the housing is pressed.

20. The image forming unit according to claim 13, wherein the buffer member is disposed only in a central portion of the operating component in a axial direction of the image carrier.

21. An image forming apparatus comprising:

an image carrier that holds an electrostatic latent image; and a neutralization device disposed to face the image carrier, wherein the neutralization device comprises:

a light irradiation section that irradiates neutralization light onto the image carrier;

a case member that accommodates the light irradiation section and is opened to a side facing the image carrier; and a buffer member that is provided between the case member and the image carrier and prevents the light irradiation section from abutting against the image carrier; and wherein the light irradiation section. the case member and the buffer member are provided to be spaced from the image carrier.

22. The image forming apparatus according to claim 21, further comprising:

a main body; and an image forming unit detachably attached to the main body, wherein the image forming unit includes the image carrier, a housing that houses the image carrier, and a seal member disposed on a downstream side of the light irradiation section in a rotation direction of the image carrier one end of the seal member is attached to the housing, the other end of the seal member is in contact with the image carrier, and a position where the buffer member is provided is lower than a position where the one end of the seal member is attached to the housing.

23. The image forming apparatus according to claim 21, further comprising:

a main body; and an forming unit detachably attached to the main body, wherein the image forming unit includes a housing that houses the image carrier, and an opening portion formed at the housing from which the image carrier is exposed, and the case member is disposed at the opening portion, wherein the housing bent when the housing is pressed.

24. The image forming apparatus according to claim 21, wherein the buffer member is disposed only in a central portion of the case member in a axial direction of the image carrier.

* * * * *